US010293898B2

(12) United States Patent
Villarreal et al.

(10) Patent No.: US 10,293,898 B2
(45) Date of Patent: May 21, 2019

(54) TOWABLE WATER SPORTS BOARD

(71) Applicants: Serigio Villarreal, Columbiaville, MI (US); Marcus J. Baker, Lapeer, MI (US)

(72) Inventors: Serigio Villarreal, Columbiaville, MI (US); Marcus J. Baker, Lapeer, MI (US)

( * ) Notice: Subject to any disclaimer, the term of this patent is extended or adjusted under 35 U.S.C. 154(b) by 0 days.

(21) Appl. No.: 15/640,243

(22) Filed: Jun. 30, 2017

(65) Prior Publication Data

US 2019/0002062 A1 Jan. 3, 2019

(51) Int. Cl.
*B63B 35/79* (2006.01)
*B63B 35/85* (2006.01)

(52) U.S. Cl.
CPC ..... *B63B 35/79* (2013.01); *B63B 35/7909* (2013.01); *B63B 35/7926* (2013.01); *B63B 35/85* (2013.01); *B63B 2035/7903* (2013.01)

(58) Field of Classification Search
CPC ..... B63B 1/00; B63B 35/00; B63B 35/73; B63B 35/79; B63B 35/7906; B63B 35/7926
USPC ..... 441/65, 74
See application file for complete search history.

(56) References Cited

U.S. PATENT DOCUMENTS 1,094,538 A 4/1914 Davis
1,510,532 A 10/1924 Zorn
1,547,097 A 7/1925 Curie
2,958,875 A 11/1960 McClain
D194,646 S 2/1963 Del Mar
3,139,055 A 6/1964 Nutting
3,145,400 A 8/1964 Youkum
3,147,498 A 9/1964 Convis
3,156,483 A 11/1964 See
D206,506 S 12/1966 Lambach
3,384,910 A 5/1968 Heston, Jr. et al.
3,395,411 A 8/1968 Pope, Jr. et al.
D220,979 S 6/1971 Belik
3,625,172 A 12/1971 Gilster
3,761,980 A 10/1973 Silverstein
3,803,652 A 4/1974 Uyehara
4,028,761 A 6/1977 Taylor
4,302,860 A 12/1981 Puch
4,437,842 A 3/1984 Connor
D317,343 S 6/1991 Concannon
5,173,068 A * 12/1992 Dunn ..... A63B 31/00 441/65
5,558,551 A 9/1996 Irby
(Continued)

*Primary Examiner* — Lars A Olson
(74) *Attorney, Agent, or Firm* — Dean W. Amburn; Giroux Amburn PC

(57) ABSTRACT

A water sports board is provided to be attached to the chest of a rider and allow the rider to hold onto a tow line of a powered watercraft and be pulled across water thus riding on the board. The water sports board is strapped to the rider utilizing an integrated harness system consisting of shoulder straps that cross the back of the rider (over a flotation device such as a life vest) and attaches to the board near the waist of the rider. The bottom of the water sports board includes a fin, ribs and water directing channels for allowing the rider to maneuver the board, and a water deflector positioned at or near the front of the board for purpose of deflecting water from spraying onto the face of the rider.

21 Claims, 7 Drawing Sheets

(56) References Cited

U.S. PATENT DOCUMENTS

| | | | | |
|---|---|---|---|---|
| 5,569,057 | A * | 10/1996 | Barsdorf | B63B 35/79 441/65 |
| 5,603,645 | A | 2/1997 | Saccomanno | |
| 5,797,779 | A | 8/1998 | Stewart | |
| 6,334,799 | B1 * | 1/2002 | Delpozo | B63B 35/7916 441/65 |
| D461,516 | S | 8/2002 | Chen | |
| D463,003 | S | 9/2002 | Alexander | |
| 6,551,157 | B1 | 4/2003 | Bishop | |
| 6,736,689 | B2 | 5/2004 | Rendard | |
| 7,422,228 | B2 | 9/2008 | Cheung | |
| 7,578,715 | B2 | 8/2009 | Wilkie | |
| 8,435,092 | B1 | 5/2013 | Smith | |
| 8,517,410 | B2 | 8/2013 | Pedersen | |
| 9,180,942 | B2 | 11/2015 | Duff | |
| 2008/0020660 | A1 * | 1/2008 | Barney | B63B 35/7906 441/65 |

* cited by examiner

TOWABLE WATER SPORTS BOARD

TECHNICAL FIELD

The invention relates generally to towable water sports boards and more particularly to a water sports board adapted to be strapped to the chest of a rider thus allowing the rider to hold a tow line of a towing boat.

BACKGROUND

Various water sports platforms exist for water sports entertainment. This includes water skis that a person stands on while being pulled behind a boat by holding onto a tow line attached to the boat. In order to water ski the user attaches the skis to their feet. In water skiing some people find it difficult to plane off from a starting point while holding onto the tow line. Others find it difficult to stay standing on the skis (or ski if slaloming) and are concerned about injury if they fall while water skiing. Not everyone desires to invest the time and effort necessary to become proficient at water skiing. Similar issues arise in wakeboarding where a wakeboard, in place of a ski is attached to the user's feet.

Another popular water sport involves being pulled behind a boat on an attached floatable device such as an air inflated "tube." The tube rider, or riders have limited, if any control over the direction of the tube which is typically directly connected by a tow line to the towing boat. However, tube riders do not need to learn how to maintain balance while planing off like water skiers do. An advantage of water skiing or wakeboarding is the ability to maintain control over movement and allow for performing maneuvers such as jumping over the wake of the towing boat or perform other acrobatic maneuvers.

Other water sports boards exist including, for example, knee boards where a rider kneels on the board, and like water skiing or wakeboarding must learn to plane off from a starting position while holding onto a tow line.

In each of the above described water sports, the rider is exposed to water spray. This can be a minor nuisance or if the water is hitting the rider on the face it may dramatically diminish any enjoyment. It becomes a safety concern if water is allowed to rush onto the face of the rider in a manner that limits the rider's ability to breath.

Safety is an important consideration when engaged in any water sport. All the above described water sports have significant capacity, if not specifically intended to detach the rider from the ski, tube or board. For example, water skis typically fall off the feet of the rider as part of the falling process. This exposes the rider to potential injury from being hit by, or entangled with a ski or tube. The same potential for injury exist with wakeboards or knee boards.

Further, comfort plays an important role in the enjoyment of any water sport. Water skis and wakeboards have limited if any cushioning to ease the comfort of the rider when traversing rougher water.

Therefore, there are opportunities to improve the water sport experience including improvements in how a rider experiences the water sport and improvements in safety and comfort.

SUMMARY

In accordance with the present invention, a new type of water sports board is provided. The water sports board is adapted to be tethered to the chest of a rider and allow the rider to hold onto a tow line of a towing boat. The water sports board includes a hull having a front portion and a rear portion. When the hull is tethered to the chest of an adult rider of average height the front portion of the hull is even with or proximately below the chin of the rider and the rear portion extends no farther than the mid-thigh of the rider. The hull has a bottom surface away from the rider. The bottom surface has a water deflector portion proximate the front portion that extends downward from the bottom surface and creates a separation from the bottom surface. The deflector portion deflects water from hitting the face of the rider. The water sports board includes a harness that is at least partially releasably attached to a top surface or deck of the hull and has at least one strap for tethering the hull to the rider.

In a non-limiting embodiment, the harness includes a first strap attachable to a first attachment point of the top surface proximate the front portion and attachable to a second attachment point proximate the rear portion. The harness also includes a second strap attachable to a third attachment point of top surface proximate the front portion and attachable to a forth attachment proximate the rear portion.

In a non-limiting embodiment, the harness straps crisscross. In another aspect of the invention, the first strap and the second strap are interconnected.

In a non-limiting embodiment, the harness is attachable to attachment points where the attachment points are disposed in the top surface. The attachment points may be substantially flush with the top surface.

In a non-limiting embodiment, the water sports board is manufactured at least in part with a three-dimensional printer. In another alternative, the hull is internally constructed of interconnected cavities. In another alternative, the interconnected cavities create a lightweight support structure supporting a solid outer surface.

In a non-limiting embodiment, the bottom surface of the hull further includes at least one fin.

In a non-limiting embodiment, the bottom surface includes at least one laterally extending channel extending from proximately the front portion to the rear portion for directing the water over the bottom surface. Alternatively, the channel extends from proximately a middle portion of the hull to the rear portion.

In a further non-limiting embodiment, the water sports board further includes a cushion disposed on the top surface. The cushion comprises at least one of the materials including rubber mat, high density foam, polyethylene (PE), neoprene, polystyrene, and polypropylene.

In a further non-limiting embodiment, the water sports board comprises at least one of the materials including high density polyethylene (HDPE) with fiberglass outer shell, molded polyurethane, ABS or PLA plastic (3D printed), injection molded expanded polystyrene (EPS).

In operation, a rider straps the water sports board onto their chest area using the harness. In the water, the rider holds onto a tow line handle attached at one end of a tow line which is attached at an opposite end to a towing boat. The boat is made to accelerate until it reaches a suitable speed allowing the water sports board to plane. While on plane, the rider experiences the sensation of coasting across the water. The rider is free to use his/her legs to influence the direction of the water sports board and effectuate acrobatic maneuvers such as jumping the towing boat's wake. The deflector portion prevents water from being pushed forward of the front portion and spray onto the face of the rider. When done riding, the rider simply releases the tow line and decelerates into the water without separating from the water sports board.

Upon further study of the specification including the drawings and appended claims, further objects and advantages of this invention will become apparent to those skilled in the art.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION

The following description of embodiments of the invention is exemplary in nature and is in no way intended to limit the invention, its application, or uses.

Figure 1:
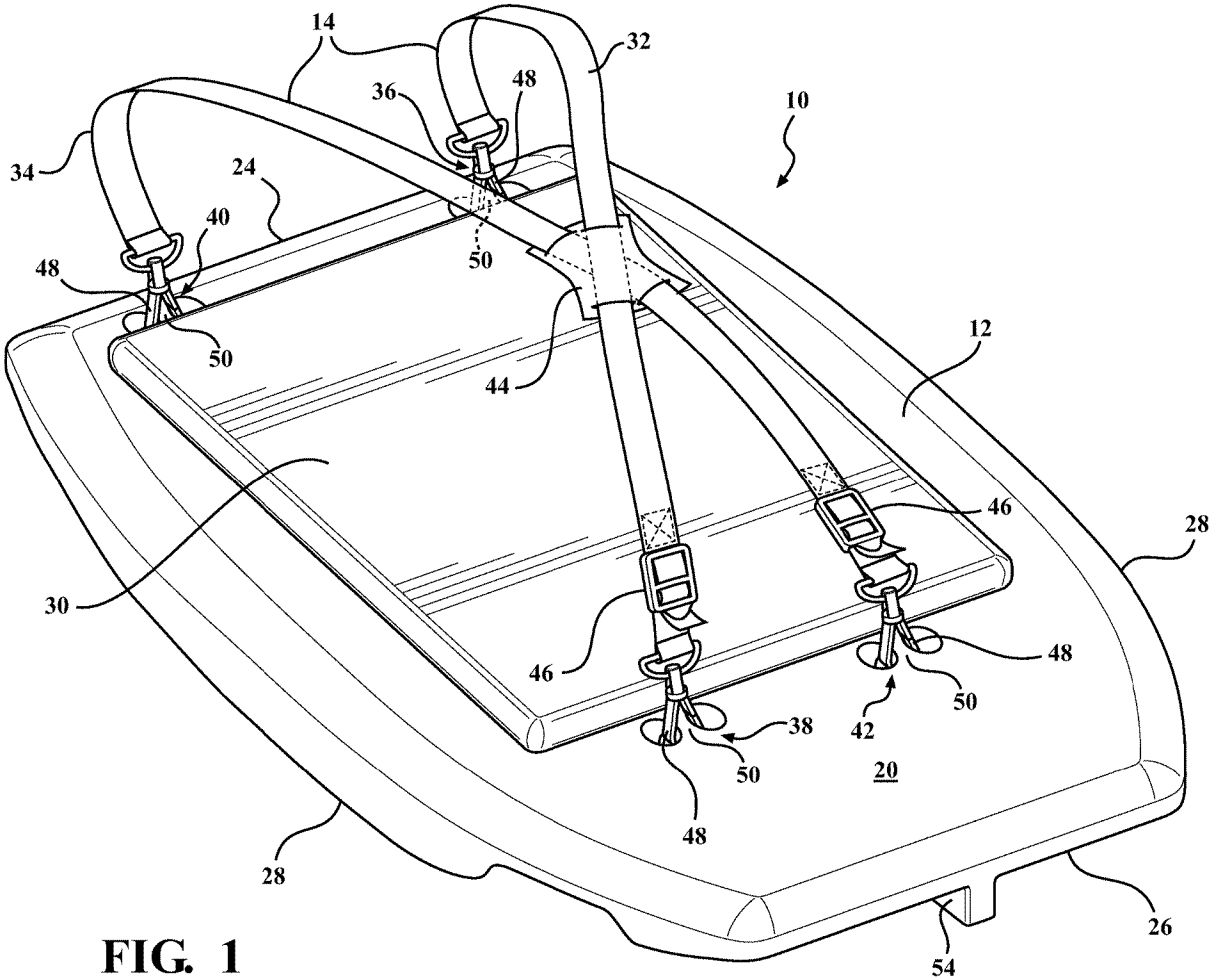
FIG. 1 is a top perspective view of the water sports board of the invention.
Figure 2:
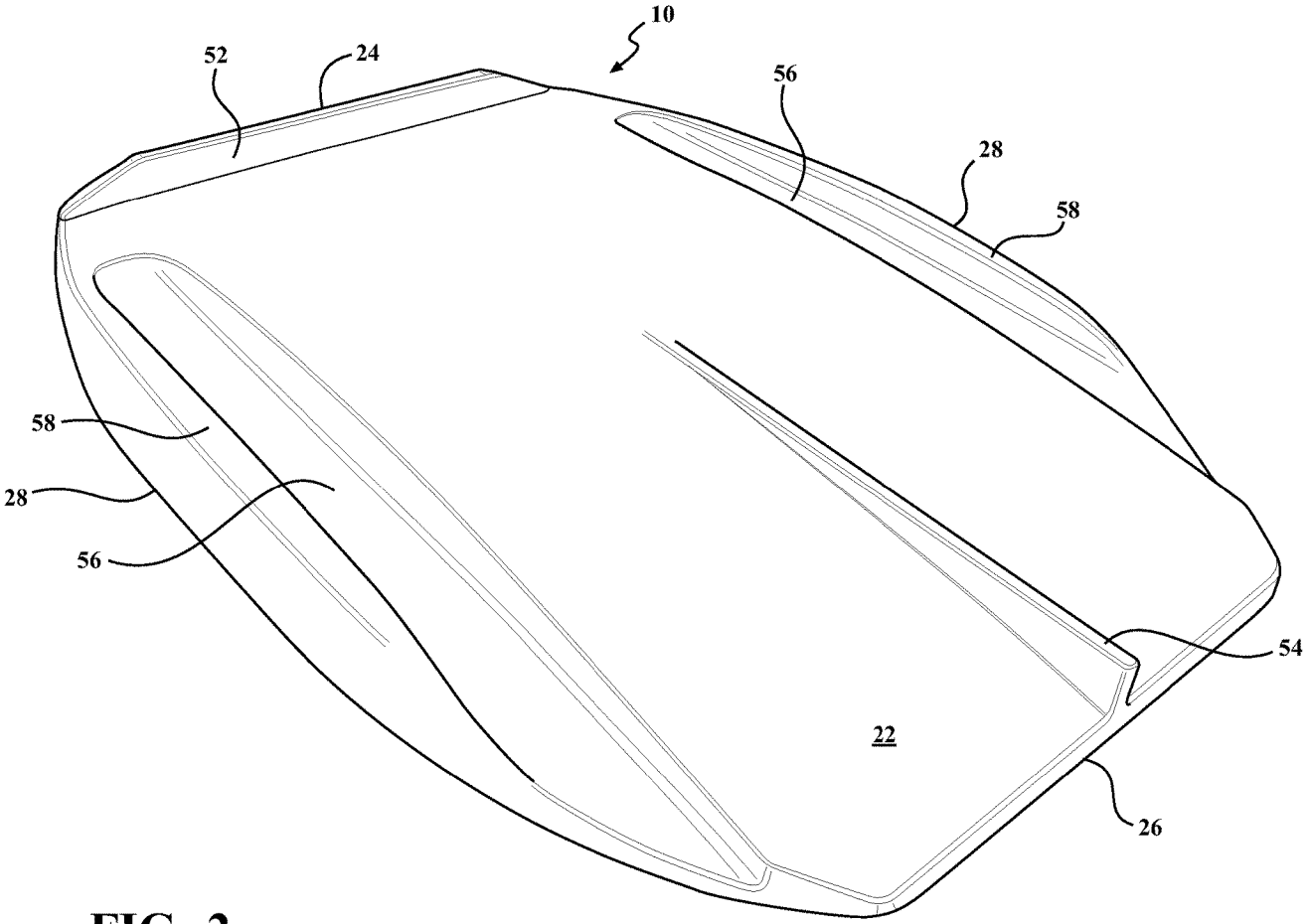
FIG. 2 is a bottom perspective view of the water sports board of the invention.
Figure 3:
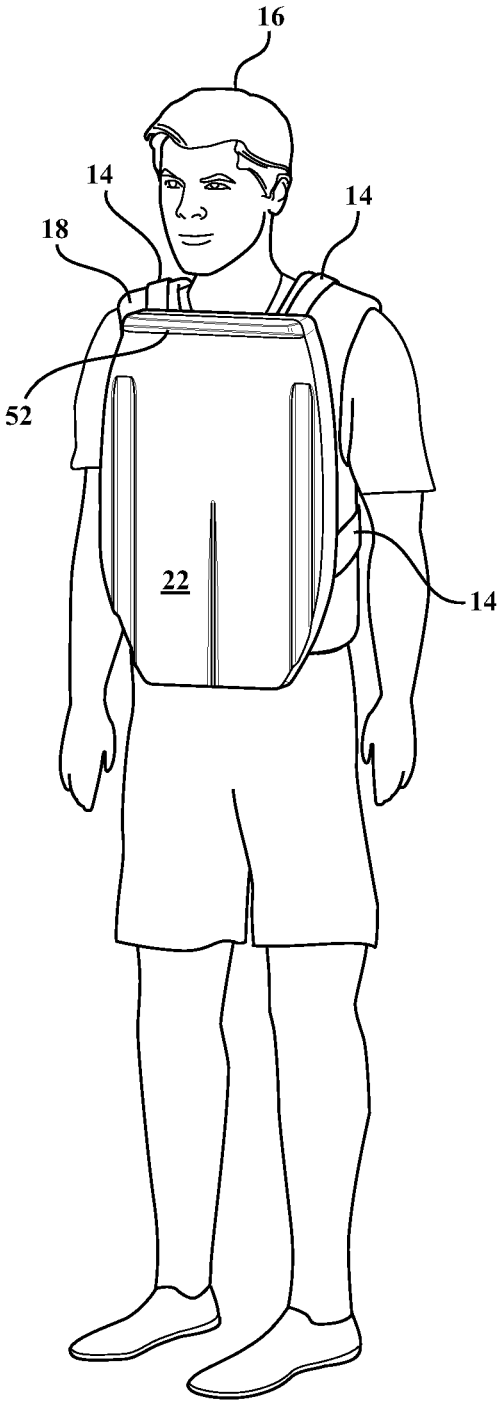
FIG. 3 is an environmental view of the water sports board tethered to a rider.
Figure 4:
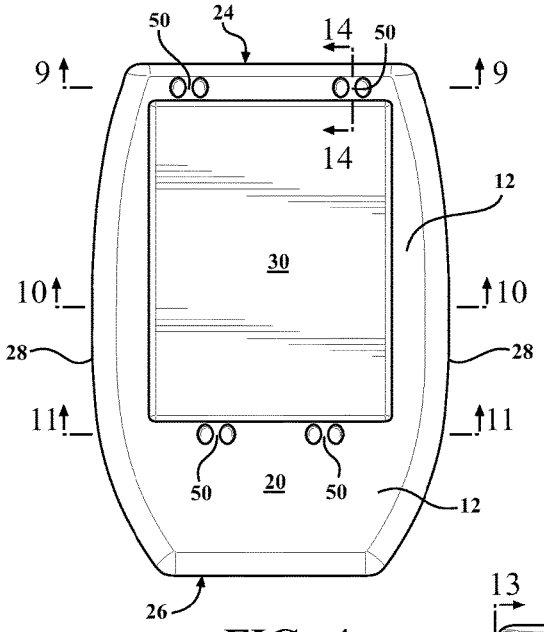
FIG. 4 is a top plan view of the water sports board without the harness.
Figure 5:
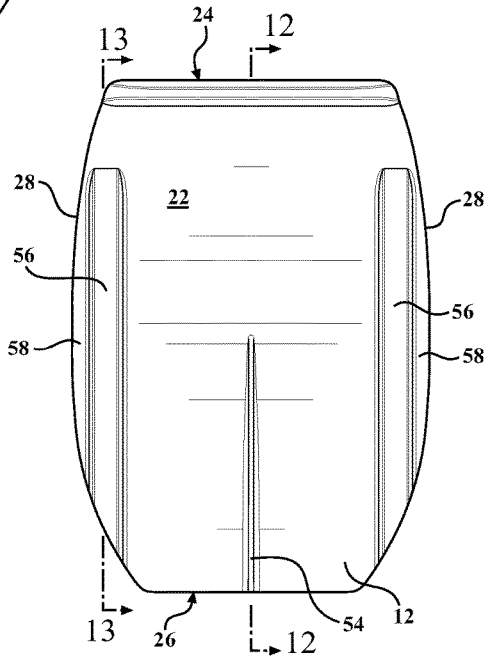
FIG. 5 is a bottom plan view of the water sports board.
Figure 6:
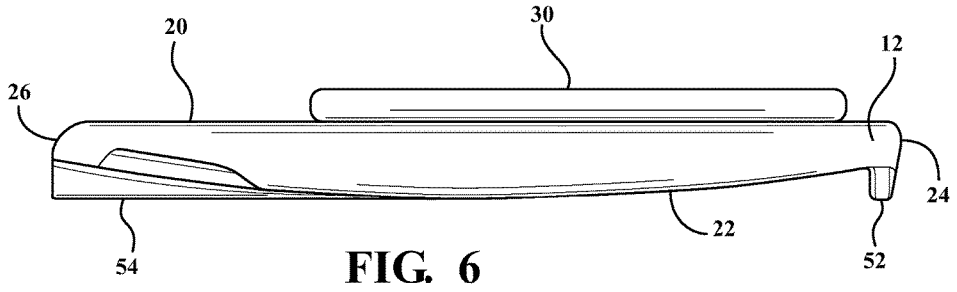
FIG. 6 is a side elevational view of the water sports board without the harness.
Figure 7:
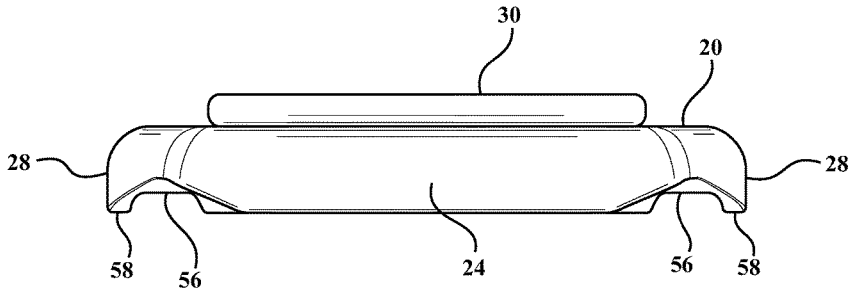
FIG. 7 is front elevational view of the water sports board.
Figure 8:
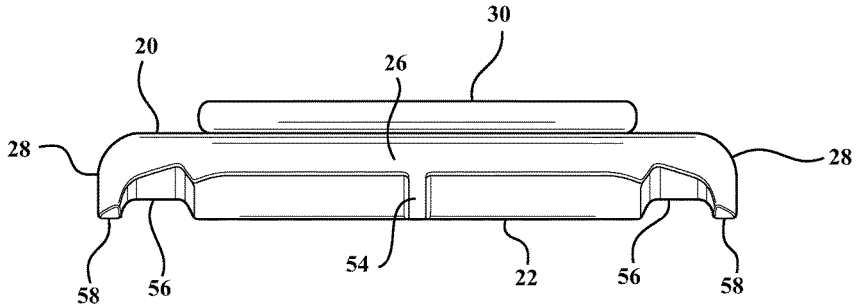
FIG. 8 is a rear elevational view of the water sports board.
Figure 9:
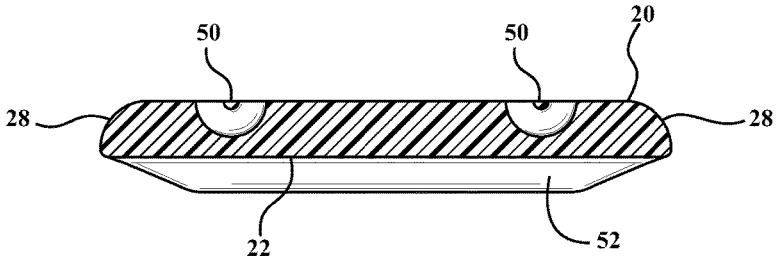
FIG. 9 is a cross-section taken along line 9-9 of FIG. 4.
Figure 10:
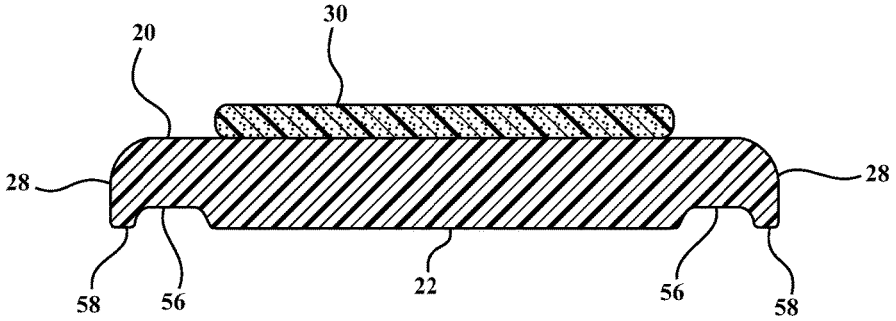
FIG. 10 is a cross-section taken along line 10-10 of FIG. 4.
Figure 11:
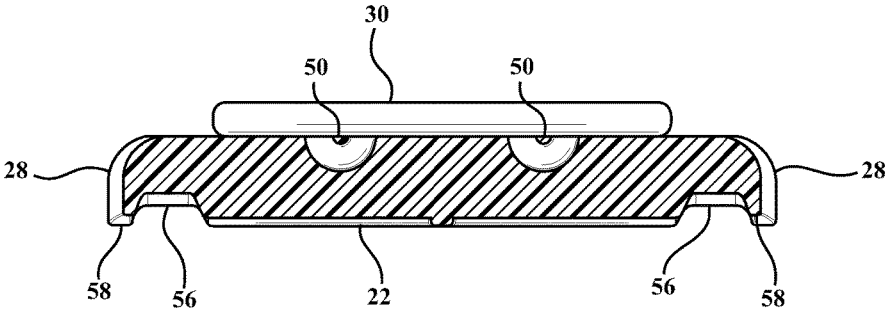
FIG. 11 is a cross-section taken along line 11-11 of FIG. 4.
Figure 12:
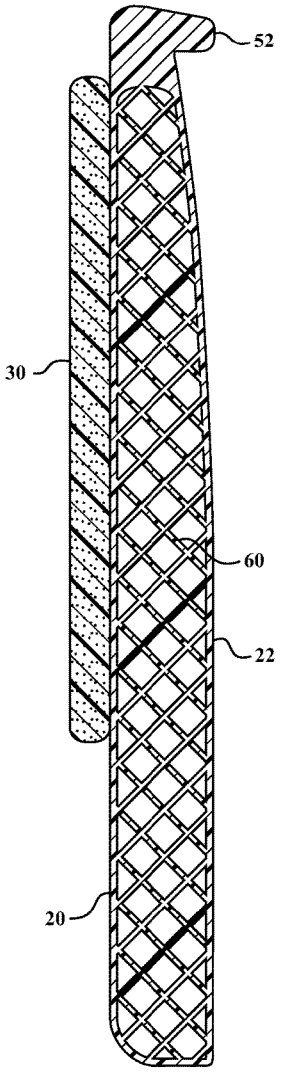
FIG. 12 is a cross-section taken along line 12-12 of FIG. 5.
Figure 13:
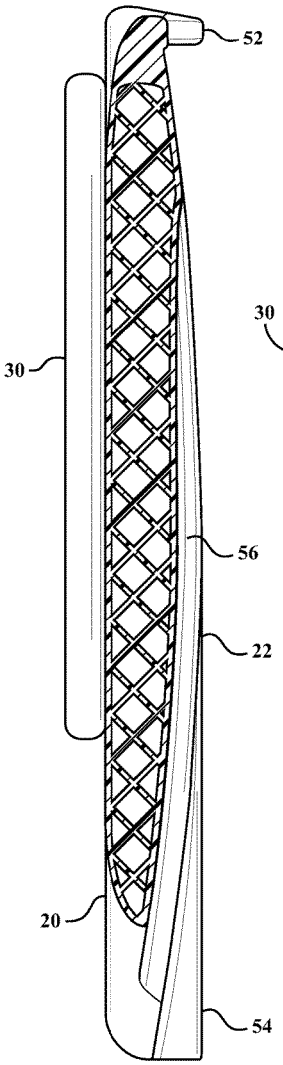
FIG. 13 is a cross-section taken along line 13-13 of FIG. 5.
Figure 14:
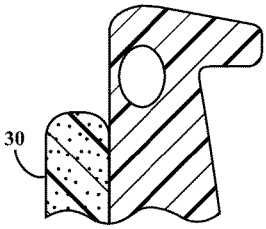
FIG. 14 is a section taken along line 14-14 of FIG. 4.

Referring to the FIGS. 1-14 the water sports board 10 of the present invention comprises a hull 12 and a harness 14. The harness 14 is adapted for tethering a rider 16 to the hull 12. Typically, the rider 16 will be wearing a flotation device 18 such as a ski vest or life preserver. The harness 14 fits over top of the flotation device 18. The harness is adjustable to fit different sized riders and create a securely held tethering of the hull 12 to the rider 16. The hull 12 has a top surface 20, bottom surface 22, front portion 24, rear portion 26 and sides 28.

Assuming the rider 16 is an adult of average height, the front portion 24 of the hull 12 will be at or beneath the chin of the rider 16 and extend to where the rear portion 26 reaches no farther than the abdomen of the rider 16. The relatively shortened length of the hull 12 allows the rider 16 to more easily control the movement of the board. Alternatively, the hull 12 is longer but, it is no longer than the mid-thigh of the rider 16.

The top surface 20 has a cushion 30 for cushioning the chest of the rider 16. The cushion 30 is made of materials known to those of skill in the art including rubber mat, high density foam, PE, neoprene, polystyrene, and polypropylene or combinations thereof. In an alternative embodiment, the flotation device 18 provides cushioning in place of the cushion 30.

In an alternative embodiment, the top surface 20 includes a spring shock absorption system in place of the previously described cushion 30. Like a traditional bedding mattress comprising cushioning materials surrounding springs, the shock absorption system includes available waterproof materials surrounding a series of springs. Thus, in this embodiment, the top surface 20 cushions the chest of the rider 16 with the integrated shock absorption system.

The harness 14 includes a first tether 32 and a second tether 34. The first tether 32 attaches at a first attachment area 36 in the upper right quadrant of the top surface 20 proximate the front portion 24, and at a second attachment area 38 in the lower left quadrant of the top surface 20 proximate the rear portion 26. The second tether 34 attaches at the third attachment area 40 in the upper left quadrant of the top surface 20 proximate the front portion 24, and at a fourth attachment area 42 in the lower right quadrant of the top surface 20 proximate the rear portion 26. The first tether 32 and the second tether 34 are interconnected at a middle attachment area 44. In an embodiment, the middle attachment area 44 comprises a material having openings for allowing the first tether 32 and the second tether 34 to be held next to each other in a slideable crossover manner. In an alternative embodiment, the first tether 32 and the second tether 34 are fixedly attached to each other at the middle attachment area 44. The middle attachment area 44 provides support allowing the rider 16 to more easily put on and properly secure the water sports board 10 in preparation for riding.

In a non-limiting embodiment, the first tether 32 and the second tether 34 are in the form of belts comprising interwoven nylon material resembling vehicle seat belts, as are readily known in the relevant art.

The first tether 32 and second tether 34 comprise adjusters 46 for adjusting the length of the tethers and thereby the fit of the harness 14 and hull 12 on the rider 16. The adjusters 46 are of the type well known to those skilled in the art including the type of adjusters commonly used with backpack straps. The adjusters 46 include a solid, typically plastic buckle that is attached to a strap at one end and allows for looping a cooperating end of the strap through the buckle to hold the straps together. Similar to backpack style straps, the user can pull the loose end of the strap looped through the buckle to remove slack and more securely hold the hull 12 onto the rider's chest.

The first, second, third and fourth attachment areas 36, 38, 40, 42 further include latching mechanisms 48 connected to latch receptacles 50. The latching mechanisms 48 are snap hooks. Alternatively, the latching mechanisms 48 may comprise different latching hardware components known to those skilled in the art. In an embodiment, the first attachment 36 and third attachment 40 are secured to the latch receptacles 50 in a non-releasable manner. The same alternative embodiment exists for the second attachment 38 and fourth attachment 42. With momentary attention drawn to FIGS. 4, 9 and 11, the latch receptacles 50 are advantageously disposed in the top surface 20, approximating half-ring shaped openings, thus removing the need for hardware that protrudes and may interfere with the rider 16, and potentially cause injury.

Returning to FIGS. 1-14, the bottom surface 22 is convex between the front portion 24 and the rear portion 26. In proximity to the front portion 24, the bottom surface 22 includes a water deflector 52. The water deflector 52 extends at an acute angle downward of the bottom surface 22 and extends for a substantial distance along the leading edge of the bottom surface 22. In an embodiment, the water deflector 52 extends at least 1.25 cm from the bottom surface 22.

The bottom surface 22 further includes a fin 54. The fin 54 runs along the longitudinal center of the bottom surface 22 originating from rear portion 26. In an alternative embodiment, the bottom surface 22 includes more than one fin. The function of the fin is to stabilize the water sports board 10 to allow it to track straight across the water.

In addition, the bottom surface 22 includes two channels 56 and rails 58 proximate to the sides 28 and running parallel to the fin 54. The channels 56 and rails 58 extend from the rear portion 26 to the front portion 24. The channels 56 and rails 58, like the fin 54 provide for straight tracking, as well as providing maneuverability for quick turns and full control of the board by the rider 16. The rails 58 also contribute to increased maneuverability.

The shape of the bottom surface 22, also known as the ride surface allows the rider 16, while being towed, to get up and coast across the plane of the water surface with little effort. The rider 16 will be able to maneuver the water sports board 10 by shifting the weight of their body from side to side. As the rider 16 is towed with the board on plane, the ride surface positions the rider 16 at an angle to the water surface that raises the upper half of their body up and away from the water at a minimal angle, as the board remains stable. The functionality of the water deflector 52 is imperative to the enjoyment of the rider. It keeps water from splashing into their face while being towed. This allows the rider to see ahead and to be able to breathe without inhaling water. As they ride across the water enacting maneuvers and traversing across the boat wake, any water that splashes from underneath towards the front of the board will be deflected away.

The distance between the top surface 20 and the bottom surface 22 is relatively thin (approximately 50 mm). This low profile keeps the rider near to the water surface which eliminates an unbalanced ride and enhances the way the board coasts across the water. The described integrated harness 14 system consists of design formations on the board that allow for the harness 14 to be attached and detached with relative ease. The harness 14 is adjustable for a snug fit around the life vest of the rider 16 which improves the rider-to-board interface.

The water sports board 10 advantageously floats in the water, but is not considered a safety floatation device. The board can be manufactured in many of the same ways that surfboards, and bodyboards are manufactured. Manufacturing methods known to those skilled in the art include an injection molded or expanded foam core with a fiberglass outer shell.

Alternatively, the board may be manufactured with a process of 3D printing the board out of plastic material, or other lightweight, durable materials, with a fiberglass outer shell as known to those skilled in the art using commercially available 3D printing systems. As a further alternative embodiment, the board is 3D printed in a substantially complete form without the need for a fiberglass cover. Advantageously, 3D printing of the hull 12 allows for creating interconnected cavities 60 within the hull. The interconnected cavities 60 allow for creating a lightweight yet strong support structure.

Varying sizes of the board will be available to accommodate varying sizes of the user, including, e.g. small for children, medium, large and extra-large for adults. The board will be less than one and a half meters in length to allow the rider to use their legs to extend over the bottom end of the board and direct movement of the board. In an embodiment, shock, impact, and energy absorption materials known to those skilled in the relevant art are incorporated into the board. It can be 3D printed with a hard ride surface from materials including at least one of polylactic acid (PLA) and acrylonitrile butadiene styrene (ABS), and a soft, flexible, impact absorbing material on the top surface including at least one of thermoplastic polyurethane (TPU), thermoplastic copolyester (TPC), and thermoplastic elastomer (TPE). This includes dual extruded 3D printing consisting of hard plastic on the bottom, and a soft flexible material on top.

Another alternative embodiment includes variations of channels 56 and rails 58 that are of differing angles, shape and dimensions. More rounded or "soft" rails 58 would allow for "drifting" sideways across the surface of the water. Different angles of the walls of the channels and angles of the rails 58 will change the fluid dynamics of board as it coasts across the surface of the water. The depth and length of the channels 58 on the ride surface will alter the dynamics of coasting. The fin 54 length, width and height are variable depending on the desired affects.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

Reference to a person or rider is intended to establish the environment of the invention but, is not a part of the invention. For the same reason, reference in the claims to a person or rider is not intended to be an element of the claims.

What is claimed is:

1. A water sports board for riding on water by a rider holding onto a tow line of a towing boat wherein the water sports board is tethered to the rider's chest, the water sports board, comprising:

a hull having a front portion and a rear portion wherein the front portion of the hull when tethered to the chest of an adult rider of average height is even with or proximately below the chin of the rider and the rear portion extends no farther than the abdomen of the rider wherein the hull has a bottom surface away from the rider wherein the bottom surface has a water deflector portion proximate the front portion that extends downward at an acute angle from the bottom surface and creates a separation from the bottom surface wherein the water deflector is adapted to ride above a water surface thereby deflecting water splashed forward from the bottom surface from hitting the face of the rider while planing; and a harness at least partially releasably attached to the top surface of the hull having at least one strap for tethering the hull to the rider.

2. The water sports board of claim 1, wherein the harness comprises a first strap attachable to a first attachment point of the top surface proximate the front portion and attachable to a second attachment point proximate the rear portion wherein the harness comprises a second strap attachable to a third attachment point of the top surface proximate the front portion and attachable to a fourth attachment point proximate the rear portion.

3. The water sports board of claim 2, wherein the first strap and the second strap crisscross.

4. The water sports board of claim 2, wherein the first strap and the second strap are interconnected.

5. The water sports board of claim 1, wherein the harness is attachable to attachment points wherein the attachment points are disposed in the top surface.

6. The attachment points of claim 5, wherein the attachment points are substantially flush with the top surface.

7. The water sports board of claim 1, wherein the hull is manufactured at least in part with a 3D printer.

8. The water sports board of claim 7, wherein the hull is internally constructed of interconnected cavities.

9. The water sports board of claim 8, wherein the interconnected cavities create a lightweight support structure supporting a solid outer surface.

10. The water sports board of claim 1, wherein the bottom surface further comprises at least one fin.

11. The water sports board of claim 1, wherein the bottom surface further comprises at least one laterally extending indentation extending from proximately the front portion to the rear portion for directing the water over the bottom surface.

12. The water sports board of claim 1, further comprising a cushion disposed on the top surface.

13. The water sports board of claim 12, wherein the cushion comprises at least one of rubber, high density foam, polyethylene (PE), and neoprene.

14. The water sports board of claim 1, wherein the hull comprises at least one of plastic (PLA, ABS) with or without a fiberglass outer shell, high density polyethylene (HDPE) with fiberglass over a shell of high density expanded polyethylene, molded polyurethane, and injection molded expanded polystyrene.

15. A water sports board comprising:

a hull having a deck, front, rear, bottom and side portions wherein the hull is sized to be tethered to an adult person's chest and extend from below the person's chin to the person's abdomen;

a water deflector disposed on the bottom portion wherein the water deflector is proximate the front portion and extends away from the bottom surface for a distance of at least 1.25 cm wherein the water deflector is adapted to ride above a water surface thereby deflecting water from rushing forward from an area of where the hull contacts water while planing; and a harness at least partially releasably attached to the deck having at least one strap for tethering the hull to the rider.

16. The water sports board of claim 15, wherein a surface of the water deflector facing the rear portion is at an acute angle to the bottom surface of between 45 and 120 degrees.

17. The water sports board of claim 15, wherein the hull is between 0.5 m and 1.5 m in length.

18. The water sports board of claim 15 wherein the hull is 3D printed with a 3D printer.

19. The 3D printed hull of claim 18, wherein the hull further comprises a 3D printed cushion on the deck wherein the cushion is 3D printed with a different material than the remainder of the hull.

20. The water sports board of claim 15, wherein the deck comprises a spring shock absorption system.

21. A water sports board comprising:

a hull having a deck, front, rear, bottom and side portions wherein the hull is between 0.5 m and 1.0 m in length;

a water deflector disposed on the bottom portion wherein the water deflector is proximate the front portion and extends away from the bottom surface for a distance of at least 1.25 cm wherein a surface of the water deflector facing the rear portion is at an acute angle to the bottom surface of between 45 and 120 degrees; and a harness at least partially releasably attached to the hull, wherein the water deflector is adapted to be above a water surface when the water sports board is in use and the hull is planing on the water surface.

* * * * *